US007671737B2

(12) United States Patent
Sellen et al.

(10) Patent No.: US 7,671,737 B2
(45) Date of Patent: Mar. 2, 2010

(54) MONITORING AND NOTIFICATION APPARATUS

(75) Inventors: Abigail Sellen, Cambridge (GB); Lorna Brown, Cambridge (GB); Abigail Durrant, London (GB); David Frohlich, Elstead (GB); Sian Lindley, Cambridge (GB); Gerard Oleksik, Bradwell (GB); Dominic Robson, London (GB); Francis Rumsey, Guildford (GB); John Williamson, Glasgow (GB)

(73) Assignee: Microsoft Corporation, Redmond, WA (US)

( * ) Notice: Subject to any disclaimer, the term of this patent is extended or adjusted under 35 U.S.C. 154(b) by 248 days.

(21) Appl. No.: 11/952,773

(22) Filed: Dec. 7, 2007

(65) Prior Publication Data

US 2009/0146803 A1 Jun. 11, 2009

(51) Int. Cl.
*G08B 1/08* (2006.01)

(52) U.S. Cl. ..... 340/539.22; 340/539.1; 340/539.17; 340/500

(58) Field of Classification Search ..... 340/539.22, 340/539.1, 539.17, 500; 455/410, 566, 566.1, 455/557

See application file for complete search history.

(56) References Cited

U.S. PATENT DOCUMENTS

| | | | | |
|---|---|---|---|---|
| 5,307,051 | A | 4/1994 | Sedlmayr | |
| 7,126,467 | B2 | 10/2006 | Albert et al. | |
| 7,151,444 | B1 * | 12/2006 | Doyle | 340/539.1 |
| 7,583,191 | B2 * | 9/2009 | Zinser | 340/541 |
| 2002/0067835 | A1 | 6/2002 | Vatter | |
| 2003/0160682 | A1 | 8/2003 | Yamada et al. | |
| 2006/0273895 | A1 * | 12/2006 | Kollin | 340/539.17 |
| 2007/0028187 | A1 * | 2/2007 | Katsuyama | 715/810 |
| 2007/0046630 | A1 * | 3/2007 | Hong et al. | 345/158 |
| 2007/0133351 | A1 | 6/2007 | Taylor | |
| 2008/0119237 | A1 * | 5/2008 | Kim | 455/566 |

FOREIGN PATENT DOCUMENTS

| | | | |
|---|---|---|---|
| EP | 0298046 | A2 * | 1/1989 |
| EP | 1755242 | A2 * | 2/2007 |

OTHER PUBLICATIONS

Laydrus, et al., "Automated Sound Analysis System For Home Telemonitoring Using Shifted Delta Cepstral Features", IEEE, 2007, pp. 135-138.*

"Sonic Interventions", at <<http://www.dwrc.surrey.ac.uk/ResearchProjects/CurrentProjects/SonicInterventions/tabid/105/Default.aspx>>, University of Surrey, Oct. 18, 2007, pp. 1.*

Virone, et al., "First Steps in Data Fusion between a Multichannel Audio Acquisition and an Information System for Home Healthcare", IEEE, 2003, pp. 1364-1367.*

* cited by examiner

*Primary Examiner*—Hung T. Nguyen
(74) *Attorney, Agent, or Firm*—Lee & Hayes, PLLC

(57) ABSTRACT

The disclosure relates to monitoring and notification apparatus capable of monitoring events at various locations. The apparatus includes a sound receiving unit which receives audio content from various locations. A user can select which of the location is monitored at any one time. In one embodiment, this selection is made depending on the orientation of the sound receiving unit.

12 Claims, 6 Drawing Sheets

MONITORING AND NOTIFICATION APPARATUS

BACKGROUND

Audible alarms and signals have long been used to notify people of a remote event. For example, doorbells provide a notification that someone is waiting outside of the door and oven timers provide a notification that a certain amount of time has expired. In addition, remote events can be monitored through the sound caused by the event itself. Baby monitors, for instance, allow a carer to react when their child is crying by transmitting sound from the baby's location to the carer's location. However, such devices are not as versatile as may be desirable.

The embodiments described below are not limited to implementations which solve any or all of the disadvantages of known monitoring and notification apparatus.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The disclosure relates to monitoring and notification apparatus capable of monitoring events at various locations. The apparatus includes a sound receiving unit which receives audio content from various locations. A user can select which of the location is monitored at any one time. In one embodiment, this selection is depending on the orientation of the sound receiving unit.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Figure 1:
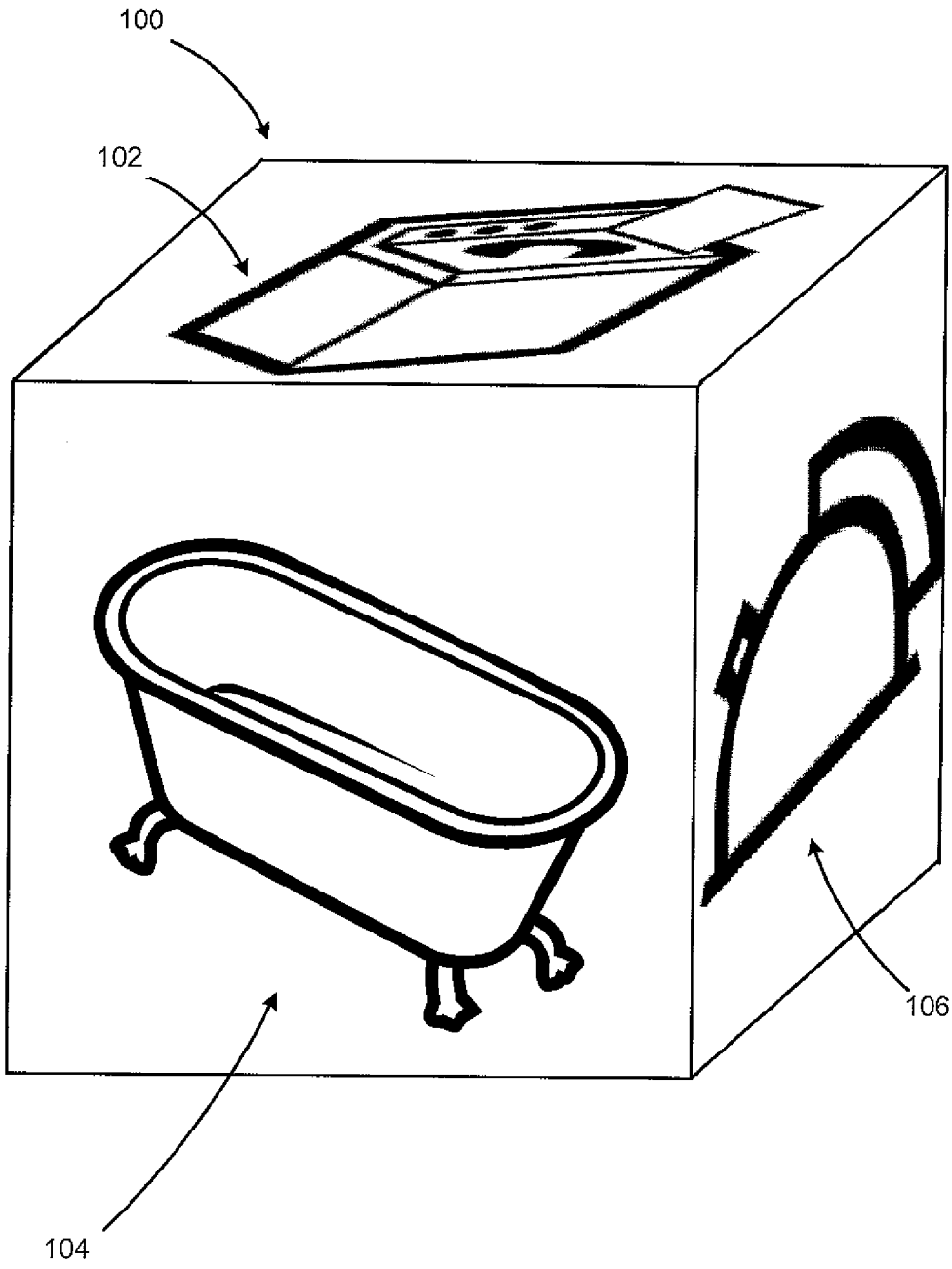
FIGS. 1 and 2 show different views of a sound receiving unit of monitoring apparatus according to an embodiment of the disclosure, FIG. 3 schematically shows processing circuitry within the sound receiving unit of FIGS. 1 and 2, FIG. 4 schematically shows the layout of a monitoring apparatus according to one embodiment of the disclosure.
Figure 2:
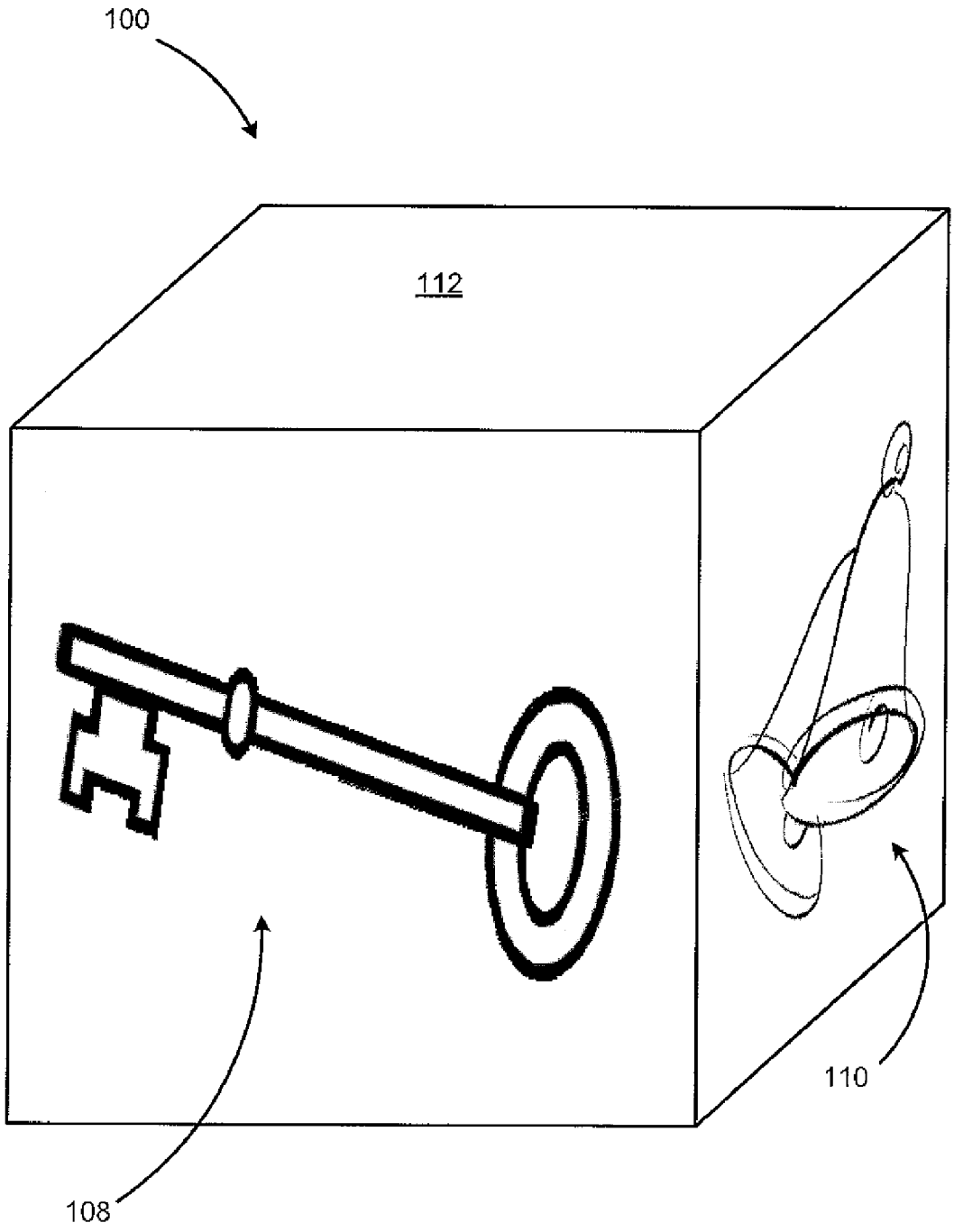

Although the present examples are described and illustrated herein as being implemented in a wireless Radio Frequency network (RF), the system described is provided as an example and not a limitation. As those skilled in the art will appreciate, the present examples are suitable for application in a variety of different types of wireless and wired network systems, The embodiment of FIGS. 1 and 2 comprises a sound receiving unit of a monitoring apparatus in the form of a cube 100 having six faces made of a plastic material. Five of the faces show an image which represents an event or occurrence which has a noise associated therewith. In this example, the images comprise a washing machine 102, a bath tub 104, a kettle 106, a key 108 and a bell 110. The sixth face is a blank face 112.

As will be explained in greater detail below, the cube 100 can be used to select to which of the five events or occurrences a user listens into. In this example, the user simply turns the face bearing the associated image upwards (although in other embodiments, the orientation for selection could be different, e.g. downwards or facing the user). The blank face 112 has no associated event; if the blank face 112 is upwards, no sound will be relayed.

It will be appreciated that the faces therefore act as display devices, arranged to show which event is being listened in on.

Figure 3:
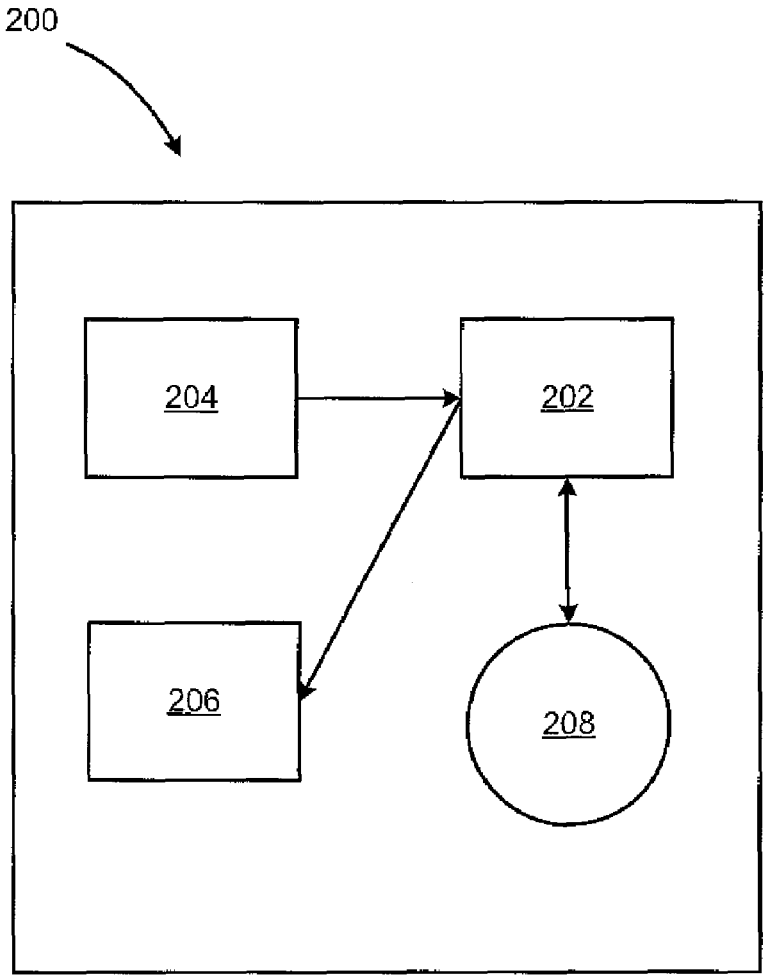

The cube 100 houses processing circuitry 200 which is now described with reference to FIG. 3. The processing circuitry 200 comprises a microprocessor 202, an orientation sensor 204 and speaker 206 and a tunable receiver module 208. The orientation sensor 204 is able to determine which face of the cube 100 is uppermost by sensing the direction of the gravitational force using three orthogonal accelerometers, and the direction of earth's geomagnetic vector with three orthogonal magnetometers.

In use of the cube 100, the microprocessor 202 receives inputs from the orientation sensor 204 and controls the receiver module 208 and the speaker 206. The inputs from the orientation sensor 204 are used to determine which event is to be monitored, and the microprocessor 202 then tunes the receiver module 208 such that it receives audio data transmitted from the location of that event as is now described in relation to FIGS. 3 and 4.

Figure 4:
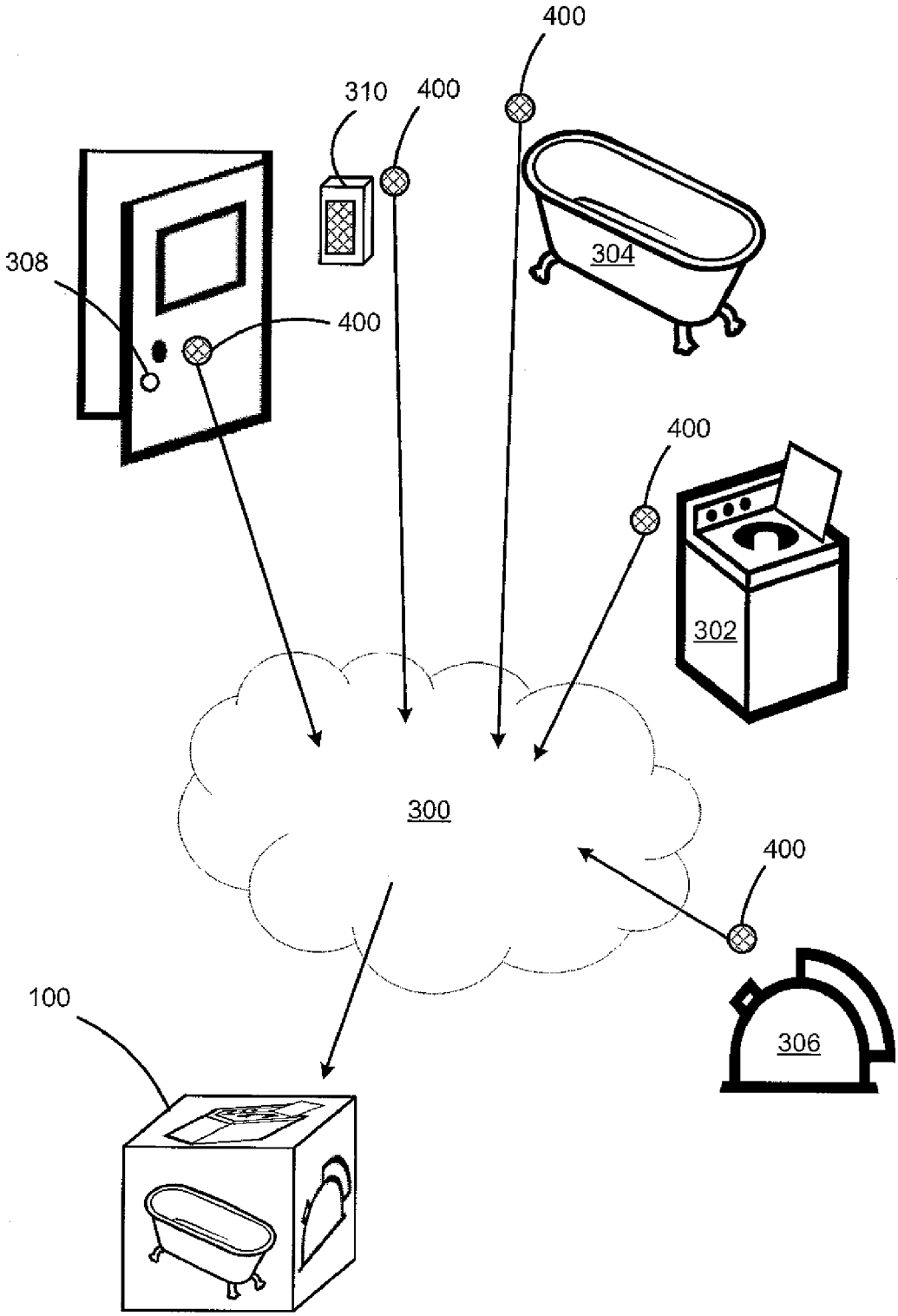
Figure 5:
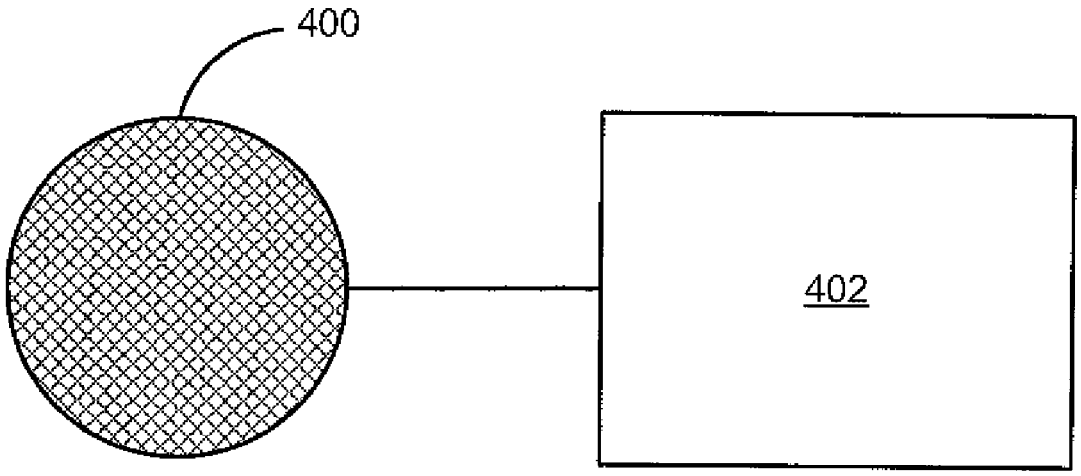
FIG. 5 shows a microphone for use with one embodiment of the disclosure.

FIG. 4 schematically shows the layout of a wireless local area network 300 within a house in which various events corresponding to images shown on the cube 100 take place. The network comprises monitoring apparatus including a plurality of microphones 400 which, as is shown in FIG. 5 comprise a transmitter module 402. A microphone 400 is positioned beside various locations at which an event is to be monitored. Specifically, these locations comprise a washing machine 302, a bath tub 304, a kettle 306, a front door key hole 308 and a front doorbell speaker 310. Each of the five microphones 400 receives sound at its location and transmits the sound received as a Radio Frequency (RF) data signal. Each microphone 400 transmits with an characteristic radio frequency. The monitoring apparatus further comprises cube 100 as a sound receiving unit.

It will be readily appreciated that an individual may want to monitor certain events at certain times without having to be in the location of the event. For example, an individual may like to check that his or her washing machine cycle has been completed so that another load can be put in to the machine 302, but does not want to have to go the machine 302. Such an individual would prefer to be able to hear the machine 302. Most machines 302 enter a spin cycle before they finish, which often has an associated noise due to its vibration. If a user could hear this noise, he or she would know that the machine 302 was near the end of its cycle and could time their trip to the location of the machine 302 accordingly. Similarly, the sound of a bath 304 filling, and in particular the change in pitch as it does so, will become familiar to an individual. Rather than having to continually check the bath 304 itself, it would be useful for a user to be able to hear the change in pitch remotely. The noise of a boiling kettle 306 is also a useful audible cue which, if a user can hear remotely, may prevent a needless trip to the kitchen, only to find that a kettle 306 has not yet boiled.

In other possible scenarios, a user may like to listen for his or her child's key in the lock 308 at around the time the child usually returns from school, e.g. 1600 hrs, but will not care to listen out for the sound all day. A user may want to hear the doorbell when out of its normal audible range.

Figure 6:
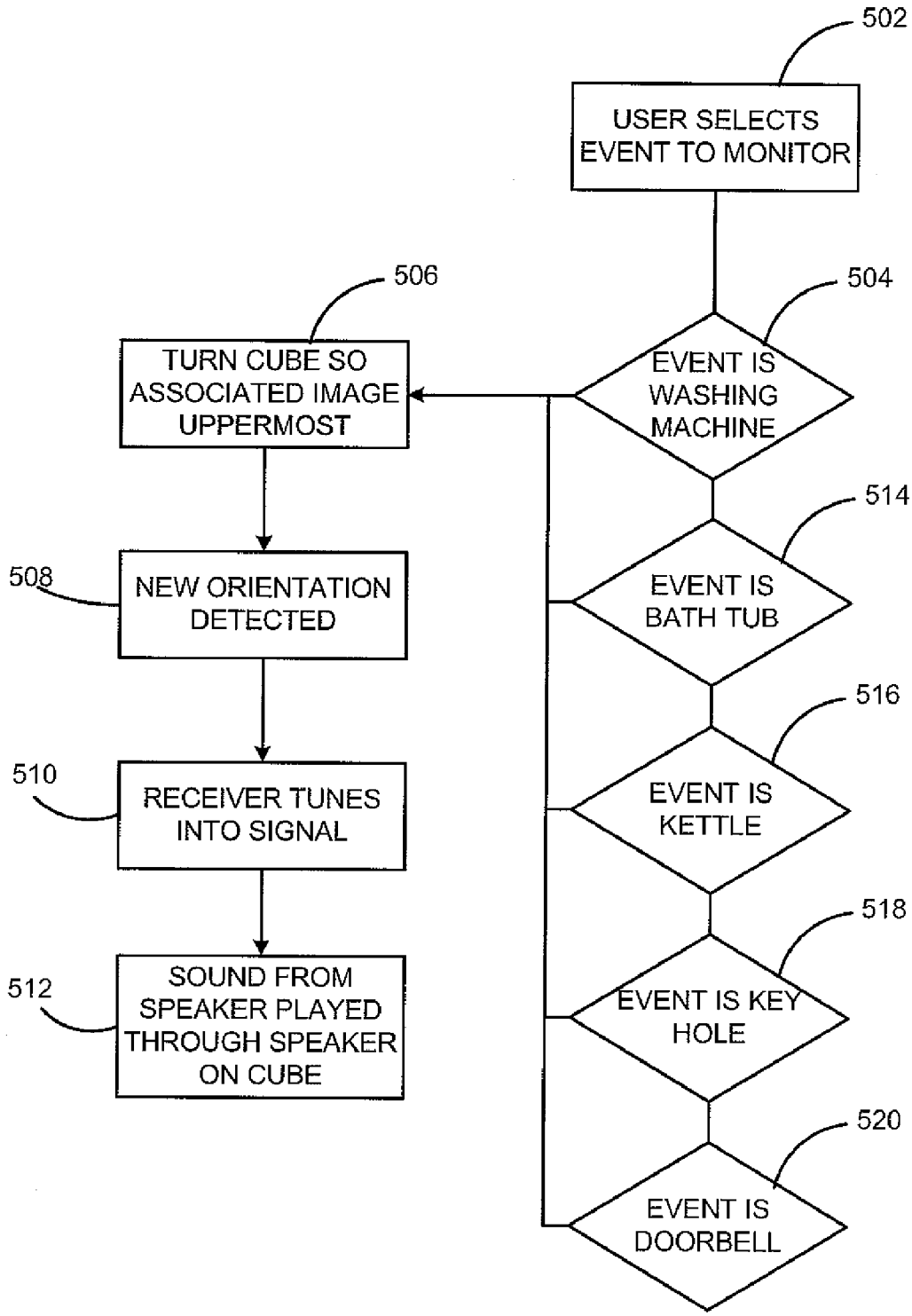
FIG. 6 shows a flow diagram of a method of using the network of FIG. 4.

Use of the monitoring apparatus is now described with reference to the flowchart of FIG. 6. First, (block 502) the user turns the cube 100 such that the face bearing the image associated with an event that the user wishes to listen out for is uppermost.

If (block 504) the event is the washing machine cycle, then the face bearing the associated image (i.e. the image of a washing machine 102) is turned uppermost (block 506). This is detected by the orientation sensor 204, which sends a signal to the microprocessor 202 (block 508). The microprocessor 202 then tunes the receiver module 208 to the frequency at which the microphone 400 at the location of the washing machine 302 transmits (block 510). The radio signal comprising data representing sound picked up by the microphone 400 at the location of the washing machine 302 is received by the receiver module 208 and played back through the speaker 206 of the cube 100 (block 512).

Alternatively, if (block 514) the event is the filling of the bath tub 304, then the face bearing the image of a bath tub 104 is turned uppermost (block 506). This is again detected by the orientation sensor 204 (block 508), resulting in the receiver module 208 being retuned (block 510) and data representing the sound picked up by the microphone 400 at the location of the a bath tub 304 is received by the receiver module 208 and this sound is played back through the speaker 206 of the cube 100 (block 512).

Similar steps are undertaken to monitor the boiling of the kettle 306 (block 516), the turning of a key in the keyhole 308 (block 518) and the sounding of the doorbell 310 (block 520). Of course, the user also has the option to leave the blank face uppermost, which results in the orientation sensor 204 sending a signal to the microprocessor 202, which in turn cause the receiver module 208 to shut down. No event is being monitored and no sound will be played through the speaker 206.

It will be readily appreciated that the above embodiment could be modified in many ways. For example, the receiving unit 100 described above is made of plastic but the unit could instead comprise wood, metal, fabric or any other suitable material. The unit described above is a cube 100. However, the unit could instead comprise a cuboid, a pyramid, a triangular base pyramid, a sphere or a disc (perhaps weighted so that it maintained a particular orientation or mounted in a holder such that it would be held in a particular orientation), or any regular or irregular polyhedral form. Turning the blank face uppermost may not result in silence, but instead allow the unit 100 to operate in an alternative mode, for example as a radio.

In one embodiment each face of the unit 100 may be a particular color and each microphone 400 is marked with an identifying color. Turning a particular colored face upwards will result in sound from the microphone with the same identifying color being played through the speaker 206.

In the example described above, the event which is monitored is selected by changing the orientation of the unit 100. However, in other embodiments, the event to be monitored may be selected on touch of a button, by touching a touch sensitive surface, by voice command or in any other way. Alternatively, the unit could be configured to tune into a particular event based on time (for example, listening to the keyhole between 1600 hrs and 1630 hrs) or to regularly cycle though all the locations. As the above embodiment is repositioned by hand, the cube 100 is of an appropriate size and weight to be held in the hand of a user. However, in other embodiments where the unit is for example repositioned or reorientated within a frame, or has a portion which is repositioned and reorientated, the size and weight may vary significantly. The unit could comprise a display device with an image of a polyhedron or other object displayed thereon. The image could be reorientated to provide the invention described in terms of a physical object (i.e. the cube 100) above.

In the embodiment described above, all of the physical elements of the apparatus were in same building connected via a wireless link. They could instead be connected via a wired link, for example using the electrical circuits within the house or using dedicated wiring. However, in other embodiments, they need not be in the same building. For example, a user could take the sound receiving unit to his or her office and listen to events at his or her home or at another location remotely. In such embodiments, an RF network may not be appropriate and the system could instead operate over a cellular telephone network, via the Internet, or via some other network.

The embodiment above comprises using images which are associated with locations where events to be monitored will occur. However, other options are possible. For example, instead of displaying images, the receiving unit could have wording on the faces or a distinctive color. In addition, the faces or any other display means could be an electronic display device such as an LCD display screen. In such embodiments, the display system may provide a graphical user interface, or other user interface of any suitable type although this is not essential.

The image/words could be permanent or configurable by a user. To that end, a face could be 'wipe clean' or adapted to have stickers bearing words or images attached thereto. Such embodiments may benefit from having a means of readily identifying the microphone 400 associated with a particular face. For example, each of the faces which is associated with a microphone 400 could be a particular color (e.g. red, blue, yellow, green, orange) and each of the microphones 400 could also be marked in that color. If, for example, the user positioned a microphone 400 with a red portion (for example a red band) by the washing machine 302, the user would then know to draw or attach an image of the washing machine on or to a red face of the unit 100. This will assist the user in configuring the system. Of course, the microphones 400 and the faces of the unit 100 could bear alternative means of associating a face with a unit 100, such as a simple symbol (e.g. square, triangle, circle, etc) on both a face and a microphone).

In other embodiments the faces could be programmable LCD panels. In such embodiments, the receiver could be arranged to programmable using a connection to a computer.

In the embodiment above, one face 112 was blank and this could be used to select when no sound should be played back. However, in other embodiments, there need not be a selectable 'silent' option.

The above embodiment is described in relation to many microphones 400 and one receiving unit 100, but this need not be the case. For example, an output could also be provided such as an audio and/or video output to a display system integral with or in communication with the monitoring device. The display system may provide a graphical user interface, or other user interfaces of any suitable type although this is not essential.

In addition, in the above embodiment, the receiving unit 100 is retuned to receive audio content from a particular microphone 400. In other embodiments, the receiving unit 100 could instead control the microphones 400 remotely such that only the microphone 400 at the location to be monitored need be operating and/or transmitting sound. This avoids the need to retune the receiver module 208. Alternatively, the microphones 400 could transmit an indication of their identity along with the audio content and this could be used by the microprocessor 202 to determine which audio content should be played through the speaker 206.

Conclusion

The term 'microprocessor' and 'computer' is used herein to refer to any device with processing capability such that it can execute instructions. Those skilled in the art will realize that such processing capabilities are incorporated into many different devices and therefore the terms 'microprocessor' and 'computer' includes PCs, servers, mobile telephones, personal digital assistants and many other devices.

The methods described herein may be performed by software in machine readable form on a tangible storage medium. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

The computer executable instructions may be provided using any computer-readable media, such as memory of any suitable type such as random access memory (RAM), a disk storage device of any type such as a magnetic or optical storage device, a hard disk drive, or a CD, DVD or other disc drive. Flash memory, EPROM or EEPROM may also be used.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

Any range or device value given herein may be extended or altered without losing the effect sought, as will be apparent to the skilled person.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description of a preferred embodiment is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the spirit or scope of this invention.

The invention claimed is:

1. Monitoring apparatus comprising: (i) a plurality of microphones capable of detecting sound and of transmitting a sound data signal representing the detected sound;

(ii) a sound receiving unit comprising: a structure have a plurality of faces;

a receiving module capable of receiving the sound data signal from the plurality of microphones, wherein:

each microphone of the plurality of microphones is associated with a face of the plurality of faces; and a particular face of the plurality of faces, associated with a particular microphone of the plurality of microphones displays an image which is associated with a location of the particular microphone;

a speaker capable of playing sound represented by the data signal received by the receiving module;

an orientation sensor capable of determining the orientation of the sound receiving unit to determine which face of the plurality of faces is uppermost;

and processing circuitry capable of selecting from which microphone sound is played back according to the orientation determined by the orientation sensor.

2. Monitoring apparatus according to claim 1 in which each face of the unit is associated with a microphone.

3. Monitoring apparatus according to claim 1 in which at least one of the faces of the unit is not associated with a microphone.

4. Monitoring apparatus according to claim 3 in which the processing circuitry is arranged such that no sound is played if the orientation sensor determines that a face which is not associated with a microphone is uppermost.

5. Monitoring apparatus according to claim 1 in which the polyhedron is a cube.

6. Monitoring apparatus according to claim 1 which comprises at least one display device arranged to display from which microphone sound is being played.

7. Monitoring apparatus according to claim 6 in which the or each display device is configurable.

8. Monitoring apparatus according to claim 7 in which the or each display device is adapted to receive an adhesive label.

9. Monitoring apparatus according to claim 7 in which the or each display device is adapted to be written or drawn upon.

10. Monitoring apparatus according to claim 1 in which the sound receiving unit is portable.

11. Monitoring apparatus according to claim 1 in which the microphones are repositionable by a user.

12. Monitoring apparatus according to claim 1 in which the microphones and the sound receiving unit communicate via a wireless link.

* * * * *